US011344994B2

(12) United States Patent
Chiocchetti et al.

(10) Patent No.: US 11,344,994 B2
(45) Date of Patent: May 31, 2022

(54) GRINDING UNIT FOR CUTTING MACHINE AND MACHINE COMPRISING SAID UNIT

(71) Applicant: Fabio Perini S.p.A., Lucca (IT)

(72) Inventors: Mario Gioni Chiocchetti, Capannori (IT); Romano Maddaleni, Bientina (IT)

(73) Assignee: Fabio Perini S.p.A., Lucca (IT)

( * ) Notice: Subject to any disclaimer, the term of this patent is extended or adjusted under 35 U.S.C. 154(b) by 376 days.

(21) Appl. No.: 16/630,577

(22) PCT Filed: Jul. 16, 2018

(86) PCT No.: PCT/IB2018/055232

§ 371 (c)(1),
(2) Date: Jan. 13, 2020

(87) PCT Pub. No.: WO2019/016667

PCT Pub. Date: Jan. 24, 2019

(65) Prior Publication Data

US 2021/0078134 A1 Mar. 18, 2021

(30) Foreign Application Priority Data

Jul. 18, 2017 (IT) ..... 102017000081320

(51) Int. Cl.

| | |
|---|---|
| ***B24B 49/16*** | (2006.01) |
| ***B26D 3/16*** | (2006.01) |
| ***B24B 3/46*** | (2006.01) |
| ***B26D 1/16*** | (2006.01) |
| *B26D 7/12* | (2006.01) |
| *B26D 1/00* | (2006.01) |
| *B26D 7/01* | (2006.01) |
| *B26D 7/06* | (2006.01) |

(52) U.S. Cl.

CPC ..... *B24B 49/16* (2013.01); *B24B 3/46* (2013.01); *B26D 1/16* (2013.01); *B26D 3/16* (2013.01); *B26D 7/0625* (2013.01); *B26D 7/12* (2013.01); *B26D 2001/0053* (2013.01); *B26D 2007/013* (2013.01); *B26D 2210/11* (2013.01)

(58) Field of Classification Search

CPC .... B24B 3/46; B26D 7/12; B26D 1/16; B26D 2210/11

See application file for complete search history.

(56) References Cited

U.S. PATENT DOCUMENTS 3,772,951 A * 11/1973 Repetto ..... B24B 3/36 69/10

FOREIGN PATENT DOCUMENTS

| | | | | |
|---|---|---|---|---|
| CN | 1946524 | A | | 4/2007 | |
| CN | 105682857 | A | | 6/2016 | |
| CN | 106938423 | A | * | 7/2017 | |
| JP | 60099564 | A | * | 6/1985 | |
| JP | H0760626 | A | * | 3/1995 | |
| JP | 2004142067 | A | * | 5/2004 | |
| WO | 2016030124 | A1 | | 3/2016 | |
| WO | WO-2016172794 | A1 | * | 11/2016 | ..... A63C 3/10 |

* cited by examiner

*Primary Examiner* — Jennifer S Matthews
(74) *Attorney, Agent, or Firm* — Breiner & Breiner, L.L.C.

(57) ABSTRACT

The grinding unit includes at least one grinding wheel adapted to rotate around a respective rotation axis, and a thrust actuator adapted to push the grinding wheel against a cutting edge of a disc-shaped cutting blade. A load cell is also provided for detecting an axial thrust exerted on the grinding wheel.

18 Claims, 3 Drawing Sheets

GRINDING UNIT FOR CUTTING MACHINE AND MACHINE COMPRISING SAID UNIT

TECHNICAL FIELD

The present invention relates to grinding units for disc-shaped cutting blades, for example for machines for cutting logs or rolls of tissue paper or the like. Cutting machines are also disclosed comprising said grinding units, as well as methods for operating the cutting machines.

STATE OF THE ART

In many industrial fields, there is the need for producing rolls or logs of web material from large diameter reels, for example parent reels coming from the paper mill. Typically, in the production of toilet paper, kitchen towels or other tissue paper products, parent reels of great diameter are firstly produced through continuous paper processing machines. These reels are then unwound and rewound to produce logs or rolls of smaller diameter, that are then cut, orthogonally to the axis thereof, into single rolls to be packed and sold to the end user.

The logs are cut by means of so-called cutting machines. The cutting machines are usually provided with a head carrying one or more disc-shaped rotating cutting blades, that are moved with a cyclic motion along a cut trajectory, for example a circular or elliptical trajectory. The disc-shaped cutting blades are subject to wear and therefore require to be periodically ground. To this end, the cutting machines are usually provided with grinding units, each of which is typically provided with at least one pair of grinding wheels. The adjustment of the pressure the grinding wheels exert on the disc-shaped cutting blade is a delicate operation, as mistakes in calibrating the force applied by the grinding wheels on the disc-shaped cutting blade can result in ineffective grinding or in the disc-shaped cutting blade being worn too fast.

There is therefore the need for providing grinding units and cutting machines comprising these grinding units, adapted to allow a better control of the grinding pressure.

SUMMARY

According to one aspect, a grinding unit is disclosed for grinding a disc-shaped cutting blade comprising at least one grinding wheel adapted to rotate around a respective rotation axis. The grinding unit further comprises a thrust actuator associated with the grinding wheel and adapted to push the wheel against a cutting edge of the disc-shaped cutting blade. The grinding unit further comprises a load cell to detect an axial thrust applied on the grinding wheel and correspondingly a force applied on the disc-shaped cutting blade by the grinding wheel.

In the present description and the attached claims, the term "load cell" refers to any sensor member adapted to detect a force or torque applied on a mechanical member. As it will be clearly apparent from the description below of some embodiments of the invention, the load cell allows to detect a reaction force applied to a support element of the grinding wheel. By detecting the reaction force, it is possible to detect the axial thrust applied on the disc-shaped cutting blade by the grinding wheel. Therefore, in some embodiments described herein, the load cell does not directly measure the force applied by the grinding wheel on the disc-shaped cutting blade, but allows obtaining it through the difference between known or measurable forces.

The measurement allows to check that the actual thrust applied by the grinding wheel on the disc-shaped cutting blade is right, taking into account all the forces acting on the grinding wheel during grinding, for example the dynamic forces generated by the movement of the cutting head where the cutting blade and the grinding unit are mounted, as well as any vibrations resulting from the normal use of the grinding unit.

Detecting the thrust force applied on the blade by the grinding wheel can be useful for many reasons. For example, it is possible to generate a feedback signal on the thrust actuator, or to detect malfunctions causing fluctuations of this force, or to verify that more grinding wheels apply the same force on the disc-shaped cutting blade.

The grinding wheel is usually inclined with respect to the cutting blade and acts on one side of the cutting edge, i.e. of the sides forming the bevel of the cutting blade. The thrust actuator may be adapted to generate a thrust in radial direction with respect to the rotation axis of the cutting blade. Due to the relative position between grinding wheel and cutting blade, the radial thrust generates an axial thrust component of the grinding wheel on the disc-shaped cutting blade, i.e. a thrust component parallel to the rotation axis of the grinding wheel.

The grinding wheel may be a disc-shaped grinding wheel, driven in rotation by an actuation motor. Vice versa, in other currently preferred embodiments the grinding wheel is mounted idle on a support and is adapted to be driven in rotation by friction between the disc-shaped rotating cutting blade and the grinding wheel. In this way, a simpler and more reliable grinding system is provided.

In embodiments described herein, the grinding unit comprises at least a pair of opposite grinding wheels, so arranged as to act on two opposite flanks of the cutting edge of the disc-shaped cutting blade. At least one of the two grinding wheels is provided with a load cell. In some embodiments, both the grinding wheels are provided with a respective load cell. In other embodiments, the grinding unit may comprise a larger number of grinding wheels, for instance four grinding wheels.

In some embodiments, the grinding unit comprises a pre-load member for pre-loading the load cell. "Pre-load member" refers, in this context, to any member adapted to apply a pre-load force on the load cell. In some embodiments, the pre-load member may be a passive member, for example a spring. In other embodiments, the pre-load member may be an active member, for instance an actuator, for example a pneumatic, hydraulic, electric cylinder-piston actuator or the like. Preferably, the pre-load member is set, or can be set, or controlled so as to apply a determinable and adjustable pre-load force.

In advantageous embodiments, the pre-load member comprises an actuator adapted to move the grinding wheel parallel to the rotation axis thereof and to bring the grinding wheel into an operative position and an idle position alternatively. In this way, by means of only one member it is possible to perform two functions, namely to pre-load the load cell and to control the grinding wheel so as to bring it into a working position and into a non-working position selectively.

In some embodiments, the grinding wheel is integral to a rotation shaft and the pre-load member is adapted to apply, to the rotation shaft, a thrust in the direction of the rotation axis of the grinding wheel. The rotation shaft co-acts with the load cell so that the load cell is adapted to detect an axial constraining reaction force applied to the rotation axis.

In particularly advantageous embodiments, the grinding wheel is supported by a rotation shaft that is rotatingly supported in a sleeve. The sleeve can be housed in a casing. In possible embodiments, the sleeve can be mounted so as to move in axial direction, i.e. parallel to the rotation axis of the grinding wheel. Moreover, the pre-load member can be so configured and arranged as to apply, on the sleeve, a thrust in axial direction, parallel to the rotation axis of the grinding wheel. Moreover, the sleeve can co-act with an axial constraint member, which can be constituted by the load cell, or to which the load cell can be associated. The load cell can be configured and arranged, with respect to the sleeve, so as to detect a constraint reaction force between the axial constraint and the sleeve.

The sleeve can be housed in a casing, on which the pre-load member is mounted. As mentioned above, the sleeve and the casing can move relative to each other parallel to the rotation axis of the grinding wheel. Moreover, the load cell can be integral to the casing. The sleeve can be so arranged as to apply, under the action of the pre-load member, a thrust on the load cell in axial direction, i.e. parallel to the rotation axis of the grinding wheel.

The grinding unit may comprise a slide, on which the grinding wheel(s) is(are) supported. The slide can be associated with the thrust actuator that can be so configured as to move the slide in radial direction with respect to a rotation axis of the disc-shaped blade.

According to a further aspect, a cutting machine is disclosed for cutting elongated products, comprising: a disc-shaped cutting blade provided with a rotation movement around a rotation axis of the disc-shaped cutting blade and provided with a cyclic cutting movement along a cutting trajectory; a feed path for the products to be cut; feed members for feeding the products to be cut along the feed path; a grinding unit as described above.

The cutting machine can be a machine for cutting paper logs or rolls, for example logs of tissue paper, for producing rolls of toilet paper, kitchen towels and the like.

In advantageous embodiments, the cutting machine comprises a cutting head, carrying at least one disc-shaped cutting blade and at least one grinding unit with one or more grinding wheels for grinding the disc-shaped cutting blade. The cutting head may be provided with a cyclic cutting movement, for example a movement along an elliptical or circular trajectory. The motion can be a continuous or reciprocating motion. The cutting head may also comprise more than one disc-shaped cutting blade and, correspondingly, more than one grinding unit.

According to a further aspect, a method is disclosed for grinding a disc-shaped rotating blade having a cutting edge, comprising the steps of:

- pushing the grinding wheel against the flank of the cutting edge by means of a thrust actuator;
- detecting, with the aid of a load cell, a thrust exerted on the flank of the cutting edge by the grinding wheel;
- possibly, controlling the thrust actuator based on the thrust detected by means of the load cell.

In some embodiments, the method may comprise the steps of:

- supporting the grinding wheel in a sleeve housed in a casing so as to slide in a direction parallel to the rotation axis of the grinding wheel;
- pre-loading the load cell by applying an axial thrust on the sleeve;
- pushing the grinding wheel into contact with the disc-shaped cutting blade by means of the thrust actuator;
- detecting a force applied by the sleeve to the load cell, said load cell being integral with the casing.

Further advantageous features and embodiments of the grinding unit, the cutting machine and the method are described in the description below and in the attached claims.

BRIEF DESCRIPTION OF THE DRAWINGS

The invention shall be better understood by following the description and the accompanying drawing, which show a non-limiting example of embodiment of the invention. More in particular, in the drawing.

DETAILED DESCRIPTION OF EMBODIMENTS

The detailed description below of example embodiments is made with reference to the attached drawing. The same reference numbers in different drawings identify equal or similar elements. Moreover, the drawings are not necessarily to scale. The detailed description below does not limit the invention. The protective scope of the present invention is defined by the attached claims.

In the description, the reference to "an embodiment" or "the embodiment" or "some embodiments" means that a particular feature, structure or element described with reference to an embodiment is comprised in at least one embodiment of the described object. The sentences "in an embodiment" or "in the embodiment" or "in some embodiments" in the description do not therefore necessarily refer to the same embodiment or embodiments. The particular features, structures or elements can be furthermore combined in any adequate way in one or more embodiments.

Figure 1:
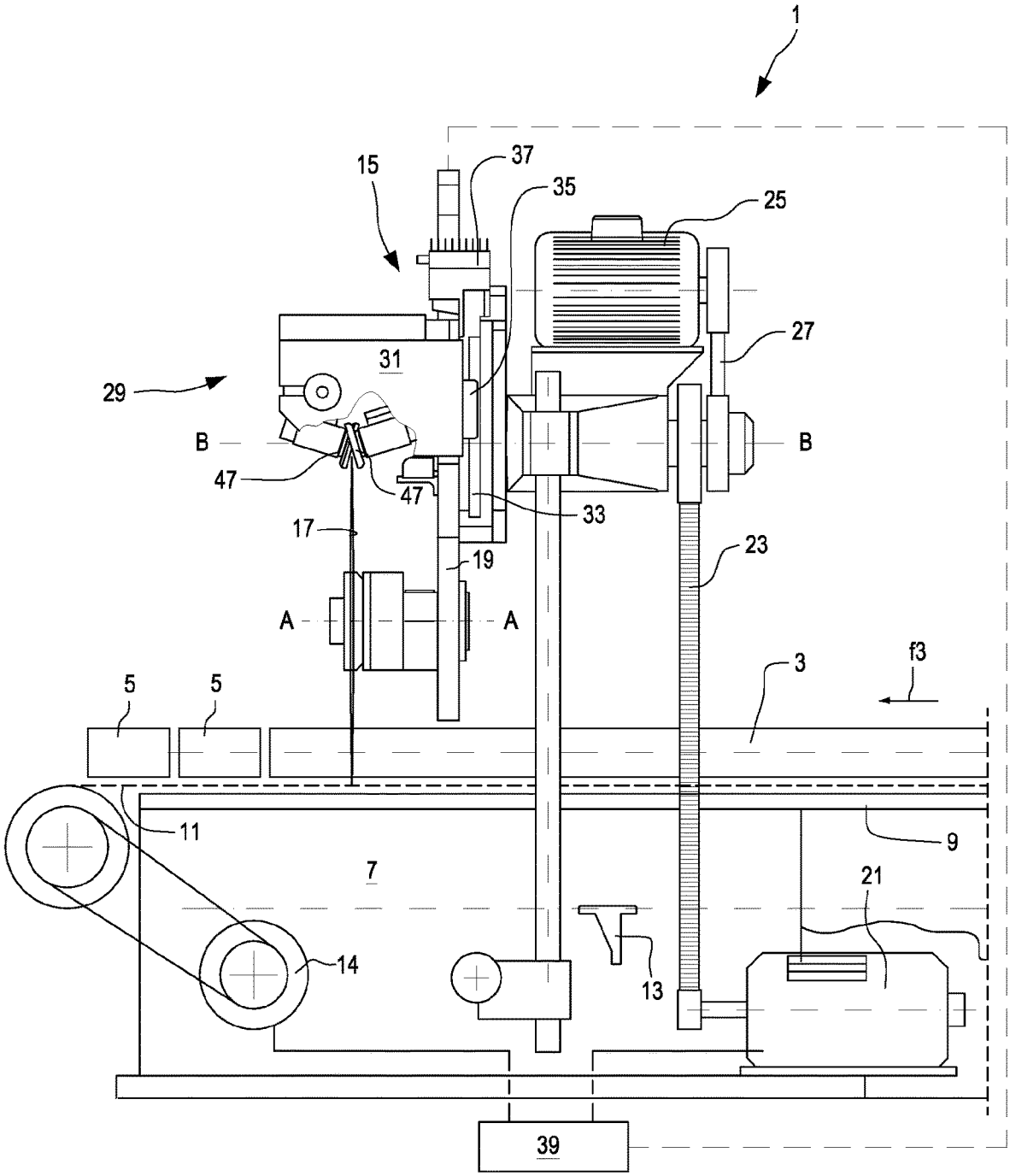
FIG. 1 is a side schematic view of a cutting machine according to an embodiment.

In FIG. 1 a cutting machine is shown for cutting elongated products, for example rolls or so-called logs of tissue paper. The cutting machine is labeled with reference number 1 as a whole, and the log to be cut is labeled with reference number 3. The cut of the log 3 produces small rolls 5 delivered by the cutting machine 1.

The cutting machines are known. They can have different configurations and layouts. The cutting machine 1 of FIG. 1 is shown just by way of non-limiting example, being understood that the features of the grinding unit described below in greater detail can be advantageously used also in differently configured cutting machines.

The cutting machine 1 illustrated by way of example in FIG. 1 comprises a bearing structure 7, on which one or more feed channels 9 are defined, along which the logs 3 to be cut move forward. A thrust system for pushing the logs 3 is associated with each channel. In some embodiments, the thrust system may comprise a flexible member 11, for example a chain or a continuous belt, on which one or more pushing members 13 are fixed, which push the logs 3 from the back to move them along the channels 9. Number 14 indicates a motor actuating the continuous flexible member 11. The forward movement of the logs 3 is indicated by the arrow f3. The forward movement can be continuous o intermittent.

The cutting machine 1 comprises a cutting head 15, on which one or more disc-shaped rotating cutting blades can be mounted, rotating around a rotation axis. In the illustrated embodiment, the cutting machine 1 comprises a single disc-shaped cutting blade 17 rotating around a rotation axis A-A. The disc-shaped cutting blade 17 can be supported on a rotating plate 19, which performs a cyclic movement, in this example a rotation movement around an axis B-B that can be substantially parallel to the axis A-A. In other embodiments, the plate or other support unit for supporting the disc-shaped cutting blade 17 may be provided with a different cyclical movement, for example a reciprocating rotation, or a movement along a closed elliptical trajectory, or any other suitable motion.

Just by way of example, reference number 21 indicates a motor transmitting rotation to the plate 19, for example through a chain 23 or any other transmission member.

The rotation of the disc-shaped cutting blade 17 around the axis A-A may be given by a further motor 25, through a transmission chain 27 or any other suitable transmission member.

A grinding unit 29 can be associated with the disc-shaped cutting blade 17. The grinding unit 29 is shown in greater detail in FIG. 2, where the structure of the plate 19 has been removed for better illustrating how the grinding unit 29 is mounted on the plate.

In some embodiments, the grinding unit 29 comprises a slide 31 movable along guides 33 that can be fastened to the rotating plate 19. The slide 31 can be slidingly constrained to the guides 33 by means of shoes 35.

In the illustrated embodiment, the slide 31 is provided with a movement according to the double arrow f31 in a substantially radial direction with respect to the rotation axis A-A of the disc-shaped blade 17, for the purposes described below. The movement according to the double arrow f31 can be applied by a thrust actuator 37. The actuator 37 can be an electronically controlled electric motor, for example. The actuator 37 can interface a central control unit 39, to which also the motor 21, the motor 25 and the motor 14 can be connected.

Figure 2:
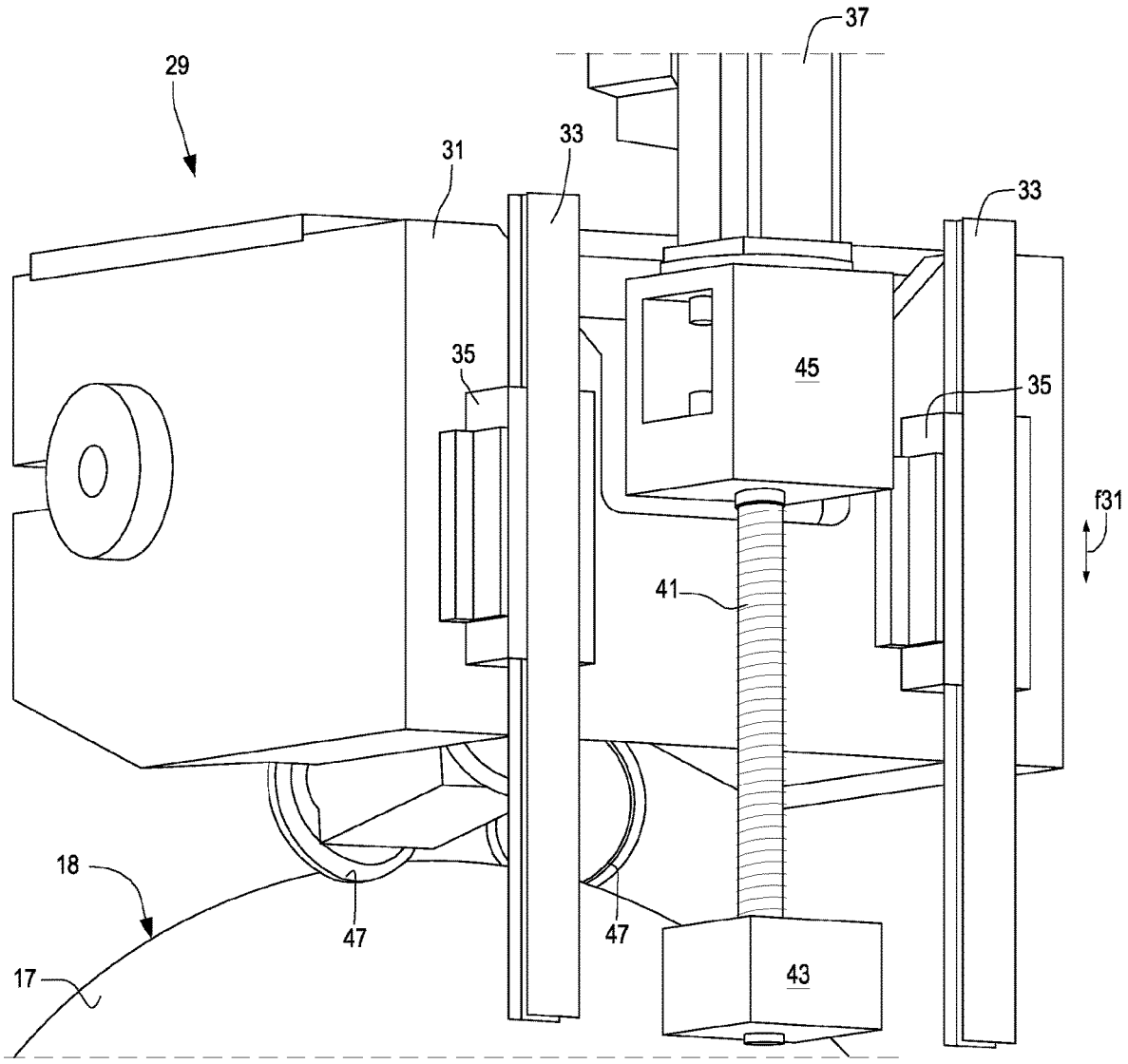
FIG. 2 is an axonometric view from the back of a grinding unit that can be mounted on the cutting machine of FIG. 1.

As shown in particular in FIG. 2, the actuator 37 can control the rotation of a threaded bar 41 supported by means of a support block 43 to the rotating plate 19. A nut screw 45, integral to the slide 31, engages the nut screw 41. In this way, the rotation, in one or the other direction, of the threaded bar 41 controlled by the actuator 37 causes the translation of the slide 31 according to the double arrow f31.

One or more grinding wheels may be supported on the slide 31 of the grinding unit 29. In particularly advantageous embodiments, the grinding unit 29 comprises two grinding wheels 47, substantially equal to each other. The grinding wheels 47 are arranged and inclined symmetrically, so as to act on opposite flanks of the cutting edge 18 (FIG. 2) of the disc-shaped cutting blade 17.

Through the thrust actuator 37 the slide 31 is radially moved towards the disc-shaped cutting blade 17 up to bring the two grinding wheels 47 to press against the cutting edge 18 of the disc-shaped cutting blade 17, with a force that can be controlled as described below. Practically, the grinding unit 29 is cyclically brought, through the actuator 37, in working position, with the grinding wheels 47 touching the disc-shaped cutting blade 17, so as periodically to grind the disc-shaped cutting blade 17. Substantially, grinding is not continuous, but performed every given number of cuts made by the disc-shaped cutting blade 17. Between a grinding operation and the following one, the actuator 37 moves the grinding unit 29 away from the disc-shaped cutting blade.

To balance wear, i.e. the reduction in the radius of the disc-shaped cutting blade 17 due to grinding, the actuator 37 imposes to the grinding unit 29 an increasingly greater stroke towards the rotation axis A-A of the disc-shaped cutting blade 17. Alternatively, it is possible gradually to move the starting point of the movement of the grinding unit 29 towards the rotation axis keeping the overall stroke of the grinding unit constant. Practically, for balancing wear, the stroke of the grinding unit 29 of movement away from the disc-shaped cutting blade 17 is reduced by an entity equal to the wear of the disc-shaped cutting blade 17. In this way, the stroke of the grinding unit 29 remains constant and does not increase as the wear of the disc-shaped cutting blade 17 increases.

In other embodiments, not shown, the grinding unit 29 may comprise more than a pair of grinding wheels 47. The grinding unit 29 may comprise, for example, two pairs of grinding wheels, for example different from each other as regards the dimensions of the grinding wheels and/or the shape of the grinding wheels and/or the features of the material of which the grinding wheels are made.

Figure 3:
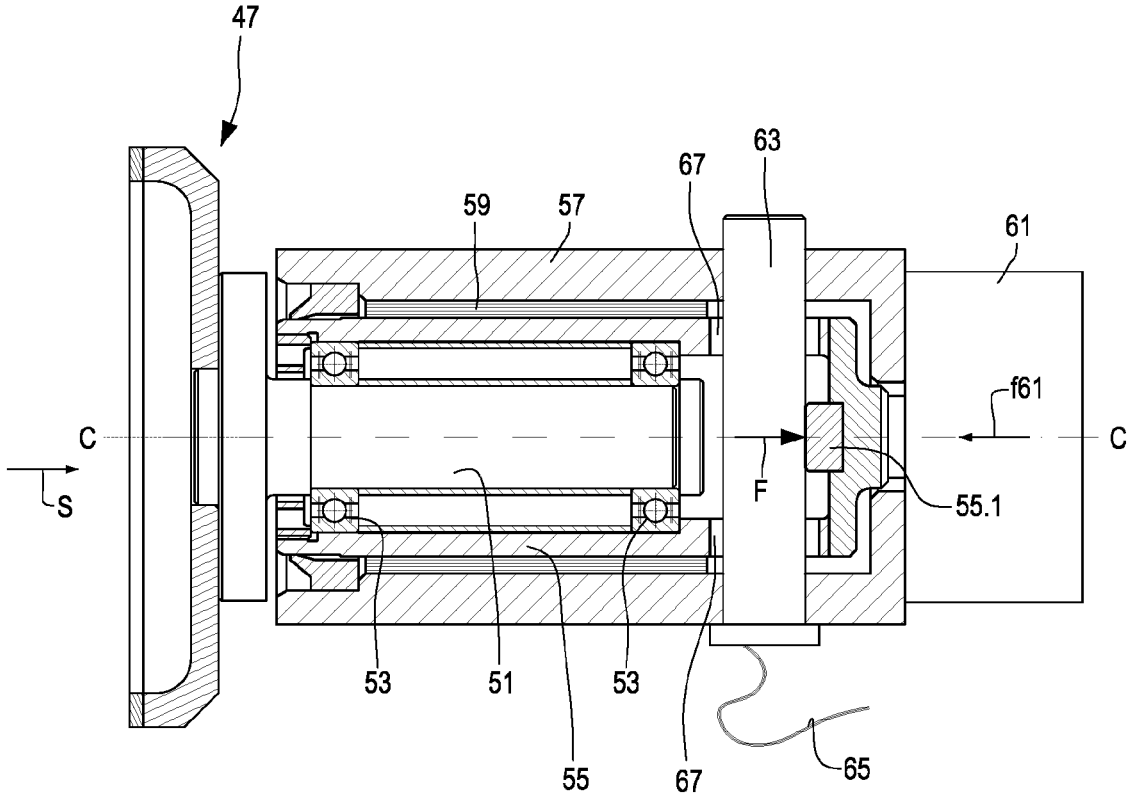
FIG. 3 is a cross-section of a grinding wheel and the related support according to a plane containing the rotation axis.

FIG. 3 illustrates a cross-section of one of the grinding wheels 47 according to a plane containing a rotation axis C-C of the grinding wheel 47. The other grinding wheel can be equal or symmetrical to that illustrated in FIG. 3. In FIG. 3, in addition to the grinding wheel, also the support members supporting the grinding wheel are visible.

In the illustrated embodiment, the grinding wheel 47 is rigidly mounted on a support shaft 51, whose axis is labeled C-C and constitutes the rotation axis of the grinding wheel 47, around which the support shaft 51 and the grinding wheel 47 are adapted to rotate integrally to each other.

The shaft 51 can be supported rotatable by means of bearings 53 in a sleeve 55. Advantageously, the shaft 51 can be mounted in the sleeve 55 so as not to translate in axial direction with respect to the sleeve 55, i.e. in a direction parallel to the rotation axis C-C of the grinding wheel 47.

In some embodiments, the sleeve 55 is housed in a casing 57 and can translate with respect to the casing 57. In some embodiments described herein, a bushing 59 or other sliding bearing can be provided, allowing the sleeve 55 to translate with respect to the casing 57 parallel to the rotation axis C-C of the grinding wheel 47.

A pre-load member 61 can be integral to the casing 57, the member applying on the sleeve 55 a thrust parallel to the rotation axis C-C of the grinding wheels 47. The thrust is indicated with arrow f61 and is directed towards the grinding wheel 47. The pre-load member 61 can be, for example, a cylinder-piston actuator. The overall thrust of the pre-load member 61 may have a fixed or a variable value, for example the value can be set by the operator.

In other embodiments, the pre-load member 61 may be an elastic member, for example a compression spring or a compression spring system, comprising helical springs, Belleville springs or the like, of which the elastic pre-load force is known.

As detailed below, the pre-load member 61 applies a pre-load on the sleeve 55. If the pre-load member 61 is constituted by an actuator, or comprises an actuator, it can be also used to move the sleeve 55, and therefore the grinding wheel 47, away from the disc-shaped cutting blade 17. This can be useful, for example, if the grinding unit has more grinding wheels that shall work selectively.

In the embodiment illustrated in FIG. 3, a load cell 63 is integral to the casing 57, wherein the load cell can be shaped like a small cylindrical bar whose ends are constraint to the casing 57 and extend orthogonally to the rotation axis C-C of the grinding wheel 47. Reference number 65 indicates a connection cable for connecting the load cell 63 to the control unit 39 or to any other system for controlling the instrumentation of the cutting machine 1.

The load cell 63 extends transversely through the sleeve 55. To this end, the sleeve 55 may have two opposite openings 67, through which the load cell 63 passes. The openings 67 have a dimension larger than the cross-section of the load cell 63. For example, if the load cell 63 has a cylindrical cross-section, the openings 67 can be shaped like slots, i.e. they can be elongated in the direction of the rotation axis C-C of the grinding wheel 47. In this way, while the load cell 63 is rigidly connected to the casing 57, the sleeve 55 can slide with respect to the load cell 63 and to the casing 57 in a direction parallel to the rotation axis C-C of the grinding wheel 47.

The sleeve 55 is pushed by the pre-load member 61 to abut against the load cell 63, which applies a reaction force, i.e. a constraint reaction on the sleeve 55. Practically, in the illustrated embodiment, the load cell 63 constitutes a support constraint for the sleeve 55 and applies a thrust F directed in a direction opposite to the pre-load force f61 applied by the pre-load member 61. In the illustrated embodiment, the sleeve 55 has a resting foot 55.1 for resting against the load cell 63.

The load cell 63 is adapted to detect the reaction force F exchanged between the load cell 63 and the sleeve 55. The pre-load member 61 also eliminates the "parasitic" forces that can act on the grinding unit 29, as the forces due to vibrations.

By assuming that the grinding wheel 47 is still and not touching the disc-shaped cutting blade 17, the reaction force F measured by means of the load cell 63 will be equal to the pre-load force f61 applied by the pre-load member 61. Vice versa, when the grinding wheel 47 is working, pushed against the disc-shaped cutting blade 17 by the actuator 37, the disc-shaped cutting blade 17 will generate on the grinding wheel 47 a thrust that has a component parallel to the rotation axis C-C and therefore orthogonal to the surface of the flank of the cutting edge 18 of the disc-shaped cutting blade 17. This component is indicated with S in FIG. 3. When the grinding unit 29 is moving, other forces can be applied on the grinding unit 29 and, in particular, on the sleeve 55. These forces can be caused, for example, by dynamic forces generated by the movement of the plate 19, on which the disc-shaped cutting blade 17 and the grinding unit 29 are mounted. These forces can have components directed according to the rotation axis C-C of the grinding wheel 47, that are algebraically added to the pre-load force f61 and therefore reduce or increase (based on the direction) the reaction force F detected by the load cell 63. Practically, these parasitic forces are negligible thanks to the pre-load applied by the pre-load member 61 on the load cell. The pre-load is therefore more useful for stabilizing the whole unit so that, in use, the cell detects a value of such an order of magnitude to make the undesired components negligible.

As the force f61 is known, and as the force F is known from the signal given by the load cell 63, it is possible to calculate the force S, with which the grinding wheel 47 presses against the flank of the disc-shaped cutting blade 17.

In this way it is possible to control, for example by means of the central control unit 39, the thrust actuator 37 so that it brings the grinding wheels 47 into the right position for applying the desired force S on the disc-shaped cutting blade 17. Control can be performed in various ways. For example, a feedback system can be provided that, based on the signal detected by means of the load cell 63, corrects any mismatch between the pre-set contact force between grinding wheel and disc-shaped cutting blade and the actual force. The mismatch is corrected by acting on the thrust actuator 37. In simpler embodiments, the control can be done simply by modifying the approaching stroke of the grinding wheels moving towards the disc-shaped cutting blade 17. For example, if with a given approaching stroke performed by means of the thrust actuator 37, a too high contact force between grinding wheel 47 and disc-shaped cutting blade 17 is obtained, a smaller approaching stroke can be performed at the subsequent cycle. Vice versa, in case of thrust lower than one set, it is possible to increase the approaching stroke.

By assuming that the two grinding wheels 47 are symmetrical and correctly set, it is possible to have the result described above by using only one load cell 63, which allows to detect the quantity of the force S of one of the two grinding wheels 47, as it is possible to assume that, due to symmetry, the other grinding wheel 47 applies an equal force on the disc-shaped cutting blade 17. It is therefore sufficient to provide each pair of grinding wheels 47 with only one load cell 63.

However, in preferred embodiments, two load cells will be provided, one for each grinding wheel 47, for measuring more precisely and for taking into account any difference due for example to errors in setting the position of the grinding wheels 47.

The load cells 63 can be used also, or alternatively to what described above, to detect anomalous fluctuations in the thrust S, that could be indicative of a malfunction or a damage of the components of the cutting machine 1, for example damages of the disc-shaped cutting blade 17. It is also possible, when both the grinding wheels 47 are provided with a load cell 63, to detect that they apply the same force on the disc-shaped cutting blade 17, contrariwise allowing the operator's intervention, for example by adjusting the position of one or the other of the grinding wheels 47.

Anomalous situations can be signaled through an alarm signal, such as a light signal or an acoustic signal. Alternatively, or in combination, it is possible to display an alarm signal on a display or on a monitor of a computer controlling the cutting machine, or of a control unit. It is also possible to send an alarm or error signal through an application from a mobile phone or other mobile device, with which the staff in charge of the control and surveillance of the machine is equipped.

A signal can be generated also in case malfunctions or anomalous fluctuations of the grinding load, occurring too early with respect to the number of performed cut, are detected. In this case, the operator can decide for an early replacement of the disc-shaped cutting blade 17.

If the cutting machine has an automatic system for replacing the disc-shaped cutting blade, the automatic system may replace the disc-shaped cutting blade for example when malfunctions or anomalous values are detected of the contact force between grinding wheels and disc-shaped cutting blade, for example significant force fluctuations. The automatic replacement can be done also taking into account the number of already performed cuts. System for automatically replacing the disc-shaped cutting blade are disclosed, for example, in WO-A-2016030124.

In some embodiments, the grinding unit with the load cell as described can be used also for automatic resetting the position of the grinding wheels when the disc-shaped cutting blade is replaced. For example, after a new disc-shaped cutting blade has been mounted, the grinding unit can be moved radially towards the new disc-shaped cutting blade detecting the thrust applied by the disc-shaped cutting blade on at least one of the two grinding wheels by means of the respective load cell. When the force detected by the load cell is equal to a set value, for example 1 kg, the position taken by the slide 31 is stored. This is the initial grinding position. At this point, the grinding cycles are performed cyclically moving the grinding unit towards and away from the disc-shaped cutting blade by means of the actuator 37. The grinding position is corrected as the disc-shaped cutting blade is worn, causing a reduction in the contact force between the grinding wheel and the disc-shaped cutting blade, that can be detected by the load cell.

The invention claimed is:

1. A grinding unit for grinding a disc-shaped cutting blade, comprising:

at least one grinding wheel adapted to rotate around a respective rotation axis;

a thrust actuator adapted to push the at least one grinding wheel against a cutting edge of the disc-shaped cutting blade;

a load cell for detecting an axial thrust exerted on the at least one grinding wheel;

a pre-load member for pre-loading the load cell.

2. The grinding unit of claim 1, wherein the pre-load member comprises an actuator adapted to move the at least one grinding wheel parallel to the respective rotation axis and to bring the at least one grinding wheel, into an operative position or an idle position.

3. The grinding unit of claim 1, wherein the at least one grinding wheel is integral to a rotation shaft; the pre-load member is adapted to apply a thrust to the rotation shaft in a direction of the respective rotation axis of the at least one grinding wheel; and the rotation shaft co-acts with the load cell so that the load cell is adapted to detect an axial constraint reaction force parallel to the respective rotation axis of the at least one grinding wheel.

4. The grinding unit of claim 1, wherein the at least one grinding wheel is supported by a rotation shaft that is rotatingly supported in a sleeve; the pre-load member is adapted to apply a thrust to the sleeve in an axial direction, parallel to the respective rotation axis of the at least one grinding wheel; the sleeve co-acts with the load cell, which is adapted to detect a constraint reaction force exerted on the sleeve.

5. The grinding unit of claim 4, wherein the sleeve is housed in a casing on which the pre-load member is mounted; the load cell is integral to the casing; and the sleeve is adapted to apply a thrust on the load cell under action of the pre-load member.

6. The grinding unit of claim 5, wherein the sleeve is mounted in the casing so as to slide with respect to the casing in a direction parallel to the respective rotation axis of the at least one grinding wheel.

7. The grinding unit of claim 5, wherein the load cell comprises an elongated element, with two ends constrained to the casing and extending transversally to the sleeve.

8. The grinding unit of claim 7, wherein the sleeve has two opposite openings, through which the elongated element extends, the openings having such a dimension as to allow the sleeve to translate with respect to the casing in a direction parallel to the respective rotation axis of the at least one grinding wheel.

9. The grinding unit of claim 1, comprising two grinding wheels so arranged as to act on opposite flanks of a cutting edge of the disc-shaped cutting blade.

10. The grinding unit of claim 1, further comprising a slide, on which said at least one grinding wheel is supported; and wherein the slide is associated with said thrust actuator, which is configured to move the slide in a radial direction with respect to a rotation axis of the disc-shaped cutting blade.

11. A machine for cutting elongated products, comprising:

a disc-shaped cutting blade provided with a rotation movement around a rotation axis of the disc-shaped cutting blade and provided with a cyclic cutting movement;

a feed path for products to be cut;

feed members for feeding the products to be cut along the feed path;

a grinding unit including at least one grinding wheel adapted to rotate around a respective rotation axis; a thrust actuator adapted to push the at least one grinding wheel against a cutting edge of the disc-shaped cutting blade; a load cell for detecting an axial thrust exerted on the at least one grinding wheel; a pre-load member for pre-loading the load cell.

12. A method for grinding a rotating disc-shaped cutting blade having a cutting edge, the method comprising steps of:

pushing at least one grinding wheel against a flank of the cutting edge;

applying a pre-load to a load cell provided for detecting a thrust exerted on the flank of the cutting edge by the at least one grinding wheel;

detecting, with aid of the load cell following the applying of the pre-load, thrust exerted on the flank of the cutting edge by the grinding wheel.

13. The method of claim 12, wherein the at least one grinding wheel is supported idle and is driven into rotation by friction between the at least one grinding wheel and the disc-shaped cutting blade.

14. The method of claim 12, further comprising controlling a thrust actuator based on the thrust detected by the load cell.

15. The method of claim 12, further comprising detecting any operating fault of the grinding unit based on the thrust detected by the load cell.

16. The method of claim 12, further comprising automatically changing the disc-shaped cutting blade based upon the thrust detected by the load cell.

17. The method of claim 12, further comprising:

moving the at least one grinding wheel towards the cutting edge of the disc-shaped cutting blade;

defining a zero position of the at least one grinding wheel in correspondence of a set thrust value detected by the load cell.

18. The method of claim 12, further comprising:

supporting the at least one grinding wheel in a sleeve housed in a casing so as to slide in a direction parallel to the rotation axis of the at least one grinding wheel;

pre-loading the load cell by applying an axial thrust on the sleeve;

pushing the at least one grinding wheel into contact with the disc-shaped cutting blade by a thrust actuator;

detecting a force applied by the sleeve on the load cell, said load cell being integral to the casing.

* * * * *